US005931645A

United States Patent [19]

Goto et al.

[11] Patent Number: 5,931,645

[45] Date of Patent: Aug. 3, 1999

[54] MULTISTAGE SWASH PLATE COMPRESSOR HAVING TWO DIFFERENT SETS OF CYLINDERS IN THE SAME HOUSING

[75] Inventors: Kunifumi Goto; Kazuo Murakami, both of Kariya, Japan

[73] Assignees: Kabushiki Kaisha Toyoda, Kariya; Jidoshokki Seisakusho, Aichi, both of Japan

[21] Appl. No.: 08/990,653

[22] Filed: Dec. 15, 1997

[30] Foreign Application Priority Data

Dec. 17, 1996 [JP] Japan ..... 8-337080
Dec. 26, 1996 [JP] Japan ..... 8-347974

[51] Int. Cl.[6] ..... F04B 1/12
[52] U.S. Cl. ..... 417/269; 417/254
[58] Field of Search ..... 417/269, 254

[56] References Cited

U.S. PATENT DOCUMENTS 4,516,913 5/1985 Girodin .
5,354,180 10/1994 Forster ..... 417/199.1

*Primary Examiner*—Timothy S. Thorpe
*Assistant Examiner*—Ehud Gartenberg
*Attorney, Agent, or Firm*—Burgess, Ryan & Wayne

[57] ABSTRACT

A multistage compressor for compressing a refrigerant for an automobile air conditioning system includes a body which has a front housing and a rear housing connected to each other with a cylinder block clamped therebetween. The cylinder block includes a plurality of sets of cylinder bores arranged parallel to, and around the longitudinal axis. Pistons are received within the cylinder bores to define a plurality of sets of compression chambers together with the walls of the cylinder bores. The sets of the compression chambers are fluidly connected to each other to provide a series of stages for compressing the refrigerant gas. The cylinder bores are arranged at equal angles around the longitudinal axis in each set of the compression chambers whereby the unbalanced force on the swash plate and the drive shaft is removed.

11 Claims, 5 Drawing Sheets

MULTISTAGE SWASH PLATE COMPRESSOR HAVING TWO DIFFERENT SETS OF CYLINDERS IN THE SAME HOUSING

BACKGROUND OF THE INVENTION

1. Field of the Invention

The invention relates to a multistage compressor for compressing a refrigerant for an automobile air conditioning system.

2. Description of the Related Art

A multistage compressor is generally used in the art for compressing a fluid to a relatively high pressure. Japanese Examined Patent Publication (Kokoku) No. 58-57635 discloses a multistage compressor for compressing a refrigerant gas for an automobile air conditioning system. Japanese Examined Utility Model Publication (Kokai) No. 63-20864 also discloses a multistage compressor similar to that in JPP '635.

A multistage compressor of the type disclosed in the above publications comprises a cylinder block including a low pressure cylinder bore and a high pressure cylinder bore which are parallel to the longitudinal axis of the cylinder block. A drive shaft extends through the cylinder block along the longitudinal axis. A low pressure piston is slidably provided within the low pressure cylinder bore to define a low pressure compression chamber. A high pressure piston is slidably provided within the high pressure cylinder bore to define a high pressure compression chamber. A swash plate, which is mounted to the drive shaft, engages the low and high pressure pistons. Both the low and high pressure pistons are reciprocated through the movement of a swash plate. The low and high pressure chambers are fluidly connected to each other to provide a two stage compressor.

In the prior art two stage compressor, an unbalanced force is generated on the swash plate and the drive shaft which results in vibration and noise since the compressor of the prior art includes only two compression chambers which are not arranged evenly around the drive shaft and produce low and high pressures in the refrigerant gas.

SUMMARY OF THE INVENTION

The invention is directed to solve the problems in the prior art and to provide a multistage compressor, of the type discussed above, which is improved to remove the unbalanced force, vibration and noise which are otherwise generated in the multistage compressor.

According to one feature of the invention, a multistage compressor for compressing a refrigerant for an automobile air conditioning system is provided. The compressor comprises a body which has a front housing, and a rear housing connected to each other with a cylinder block clamped therebetween. The front housing and the cylinder block define a swash plate chamber. The cylinder block has a longitudinal axis and includes a plurality of sets of cylinder bores arranged parallel to and around the longitudinal axis. Pistons are received within the cylinder bores to define a plurality of sets of compression chambers together with the walls of the cylinder bores. A drive shaft for driving the reciprocation of the pistons is supported by the body for rotation, and drivingly connected to a rotational power source. A swash plate is mounted to the drive shaft to engage the pistons. The rotation of the drive shaft is transformed into the reciprocation of the pistons by the swash plate. The sets of compression chambers are fluidly connected to each other to provide a series of stages for compressing the refrigerant gas. The cylinder bores are arranged at equal angles around the longitudinal axis in each set of compression chambers whereby the unbalanced force on the swash plate and the drive shaft, which is generated due to the pressure difference between the cylinder bores which are not arranged evenly in the art, is removed.

DESCRIPTION OF THE DRAWINGS

These and other objects and advantages and a further description will now be discussed in connection with the drawings in which.

DESCRIPTION OF THE PREFERRED EMBODIMENTS

Figure 1:
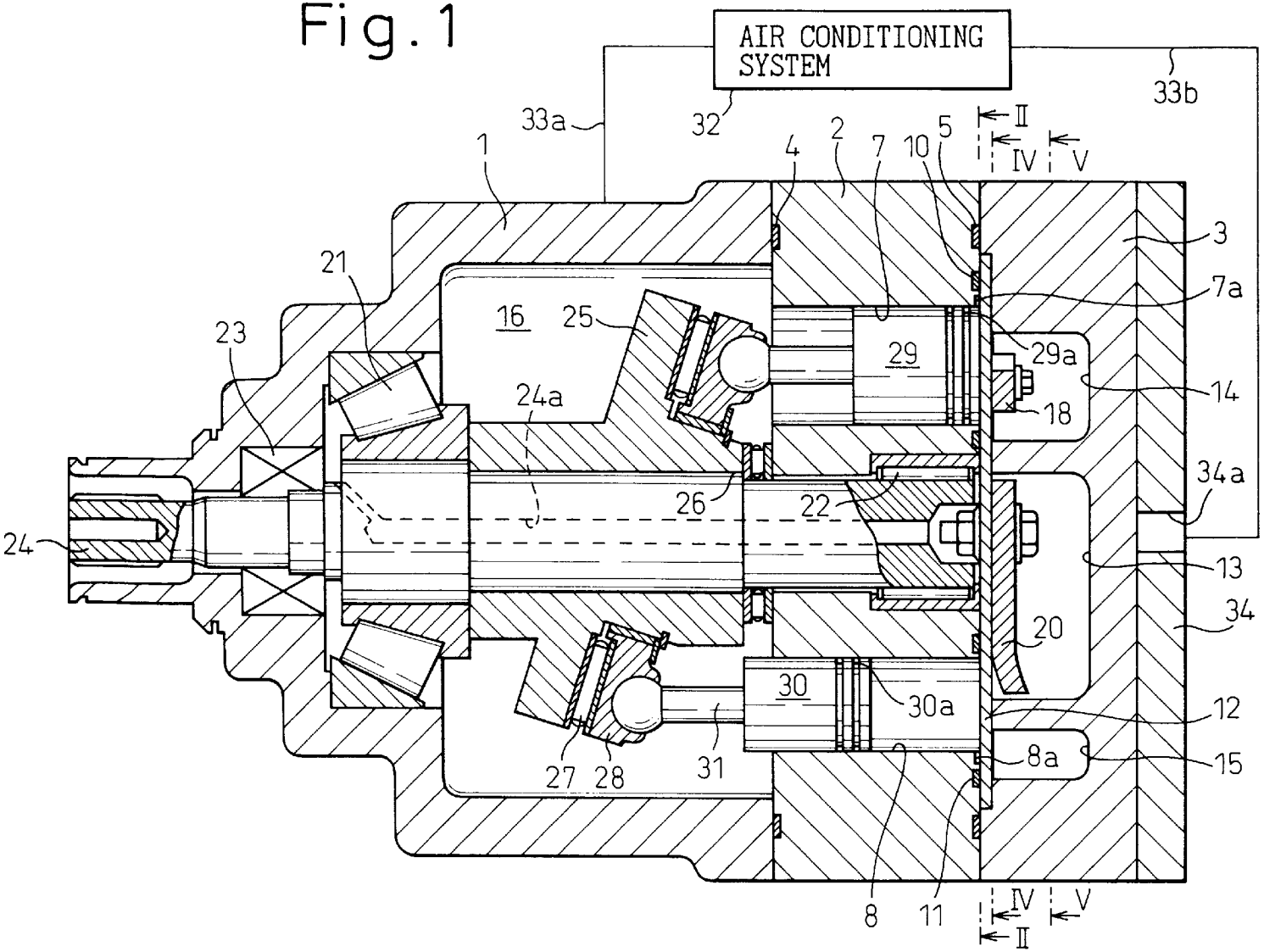
FIG. 1 is a longitudinal section of a multistage compressor according to the preferred embodiment of the invention.

With reference to FIG. 1, a two stage compressor according to an embodiment of the invention is used for compressing a refrigerant gas for an automobile air conditioning system 32. The compressor comprises a front housing 1, cylinder block 2 having a longitudinal axis, a rear housing 3, and a drive shaft 24 which extends through the front housing 1 and cylinder block 2 along the longitudinal axis of the compressor. The drive shaft 24 is supported by bearings 21 and 22 for rotation. The driving shaft 24 is drivingly connected to an automobile engine (not shown) through a compressor pulley (not shown) attached to the front end (left end in FIG. 1) of the drive shaft 24 and a V-belt (not shown) which extends between the compressor pulley and an engine pulley on the crank shaft of the automobile engine.

The front housing 1, cylinder block 2 and the rear housing 3 are connected by screw bolts 6 (FIGS. 2–5) to form a body of the compressor. The front housing 1 and the cylinder block 2 define a swash plate chamber 16. O-rings 4 and 5 are provided between the front housing 1 and the cylinder block 2 and between the cylinder block 2 and the rear housing 3.

Within the swash plate chamber 16, a swash plate 25 is mounted to the drive shaft 24 to rotate with the drive shaft 24. A thrust bearing 26 bears the thrust load on the swash plate 25.

The cylinder block 2 includes a first set of three cylinder bores 7 having a larger diameter and a second set of three cylinder bores 8 having a smaller diameter. The first and second cylinder bores 7 and 8 are alternatively arranged at equal angles around and parallel to the drive shaft 24. The first and second cylinder bores 7 and 8 slidably receive first and second sets of pistons 29 and 30 so that the first and second sets of cylinder bores 7 and 8 and the pistons 29 and 30 define first and second sets of compression chambers, respectively. The first set of compression chambers provide a low pressure stage. On the other hand, the second set of compression chambers provide a high pressure stage. According to the embodiment, the first and second pistons 29 and 30 include piston rings 29*a* and 30*a* for preventing compressed refrigerant gas from escaping between the first cylinder bores and pistons 7 and 29 and between the second cylinder bores and pistons 8 and 30. The first and second pistons 29 and 30 are drivingly connected to the swash plate 25 through piston rods 31 and shoes 28, which is connected to the swash plate 25 through a thrust bearing 27.

The rotation of the drive shaft 24 is converted into the reciprocation of the first and second pistons 29 and 30 within the first and second cylinder bores 7 and 8. A tilting mechanism (not shown) may be provided between the swash plate 25 and the drive shaft 24 to change the angle of the swash plate 25 relative to the drive shaft 24 so that the capacity of the compressor or the flow rate discharged from the compressor can be changed.

Figure 2:
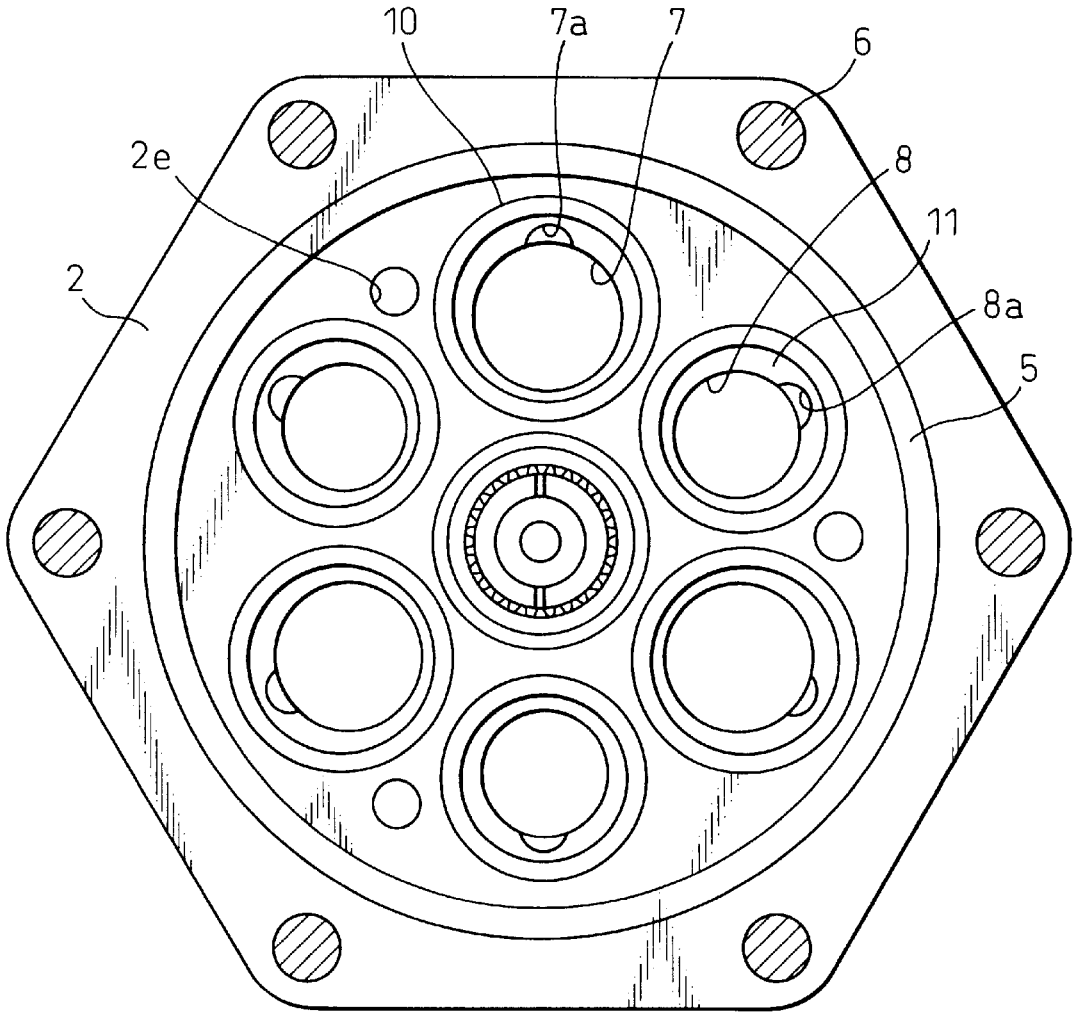
FIG. 2 is an illustration viewing along line II—II in FIG. 1, and shows a rear end face of a cylinder block.

With reference to FIG. 2, the cylinder block 2 includes a plurality of suction passages 2*e* which extend from the swash plate chamber 16 to the rear end face of the cylinder block 2. The compressor further includes a suction valve 9 substantially in the form of a circular thin sheet of steel (not shown in FIG. 1 but shown in FIG. 3) and a valve plate 12 substantially in the form of a circular plate member between the cylinder block 2 and the rear housing 3.

Figure 3:
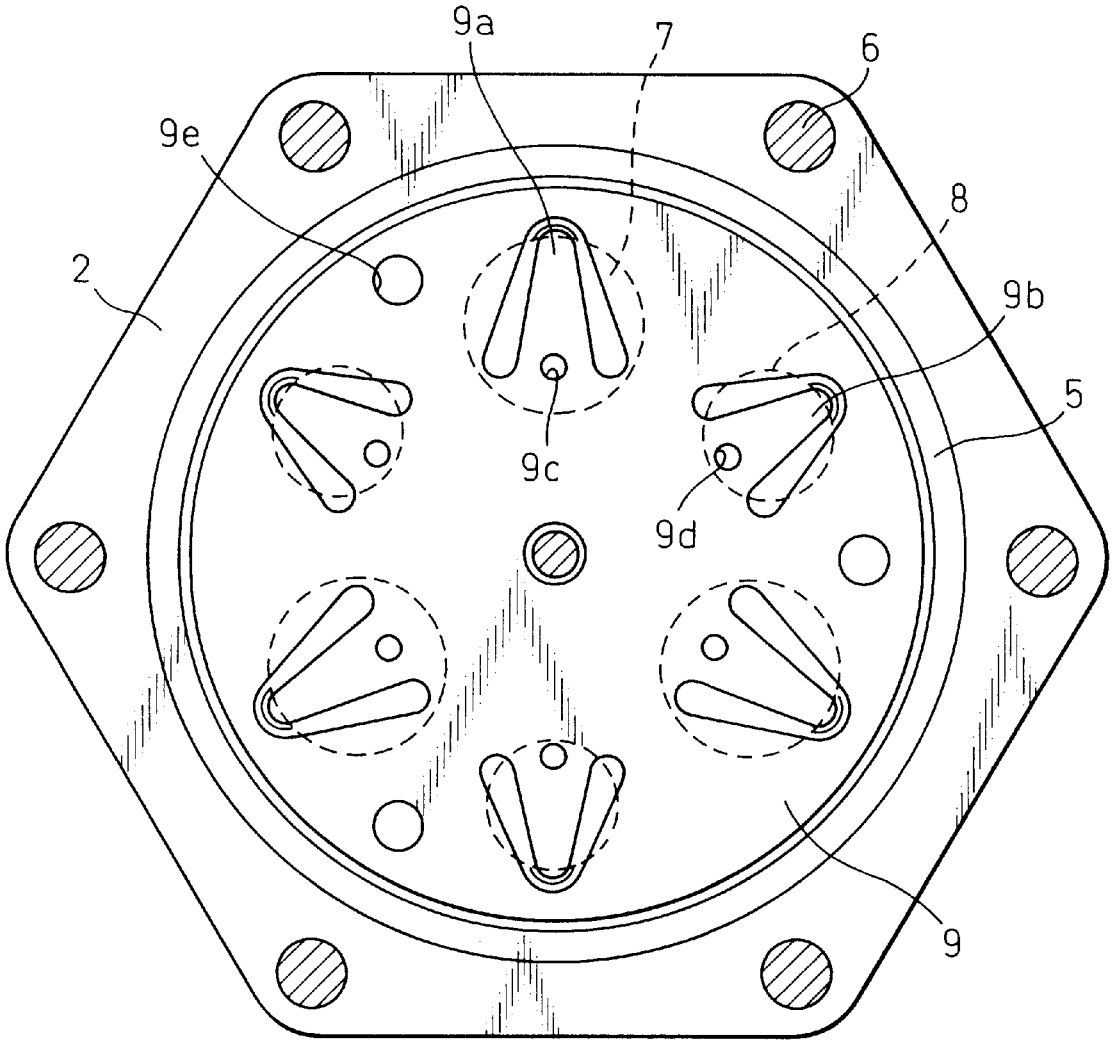
FIG. 3 is an illustration viewing along line II—II in FIG. 1, and shows a suction valve provided on the end face of the cylinder block.
Figure 4:
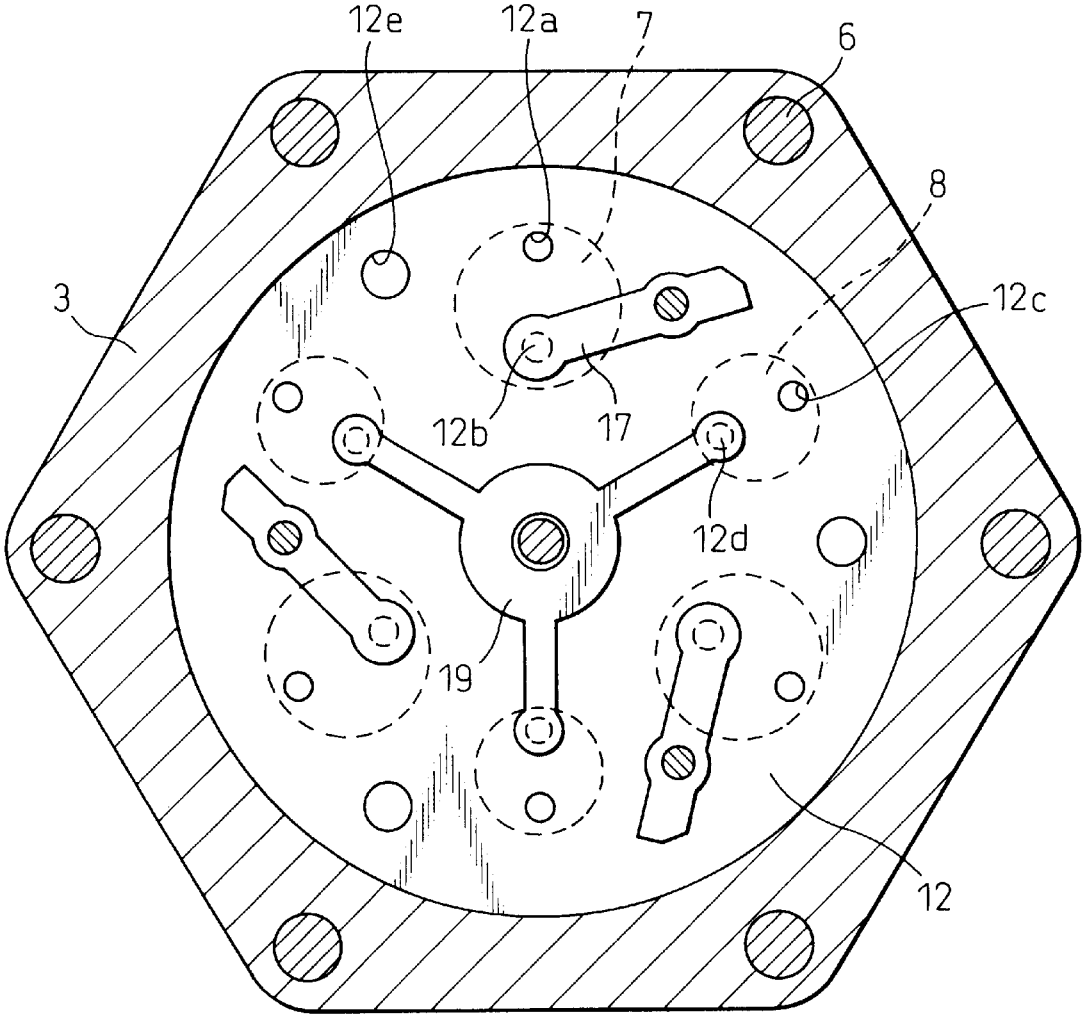
FIG. 4 is a section along line IV—IV in FIG. 1 and shows a valve plate which is provided between the suction valve and the rear housing.
Figure 5:
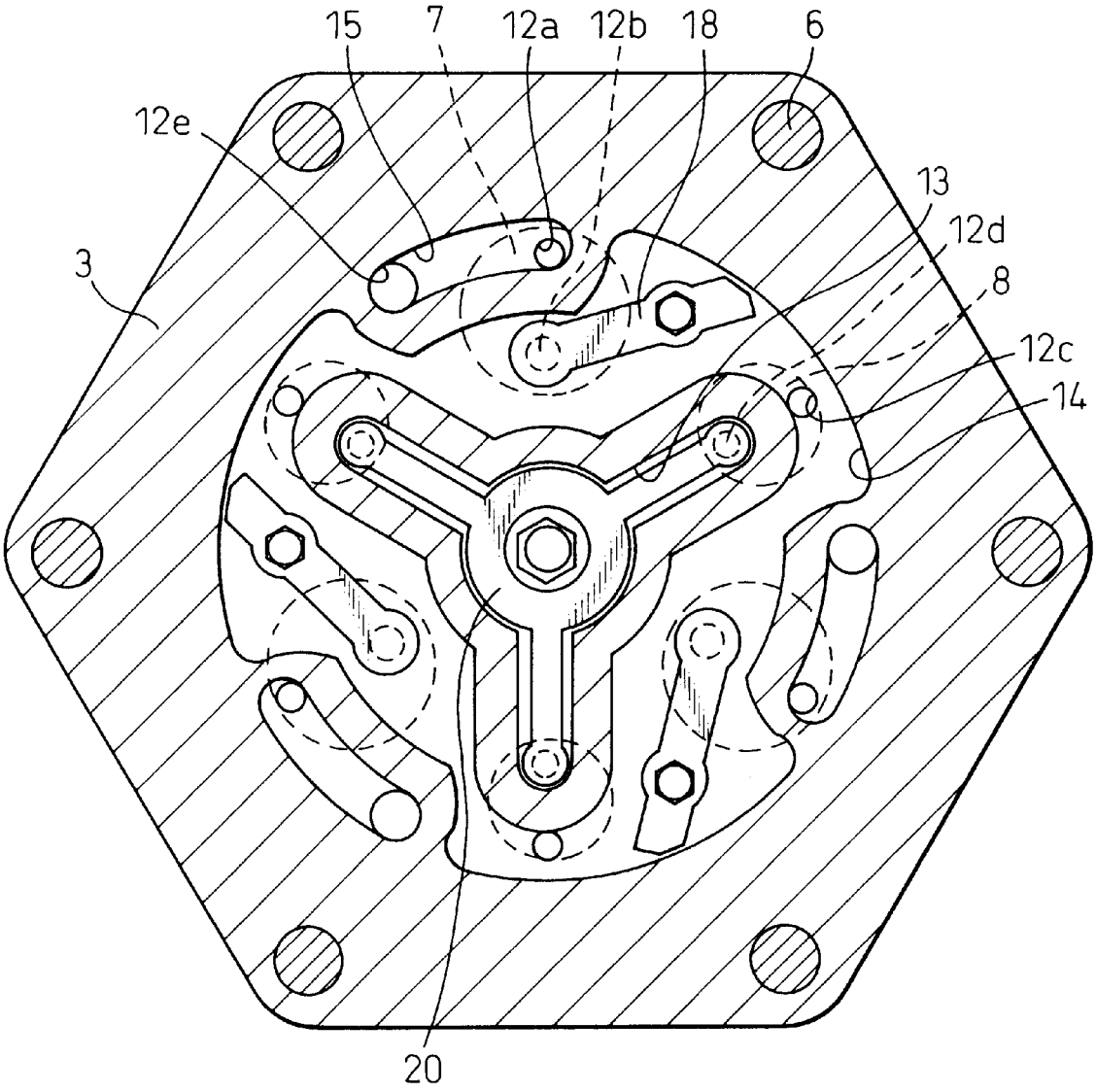
FIG. 5 is a section along line V—V in FIG. 1 and shows the arrangement of suction, intermediate and discharge chambers defined by the rear housing.

It should be noted that both FIGS. 2 and 3 are views along line II—II in FIG. 1, however, FIG. 2 shows the rear end face of the cylinder block 2 and FIG. 3 shows the suction valve 9 provided on the end face of the cylinder block 2. FIG. 4 is a section along line IV—IV in FIG. 1 and shows the valve plate 12 which is provided between the suction valve 9 and the rear housing 3.

The suction valve 9 includes first and second suction valve portions 9*a* and 9*b* in the form of large and small triangles. The first and second valve portions 9*a* and 9*b* are arranged alternatively around the longitudinal axis of the cylinder block 2 so that the first and second valve portions 9*a* and 9*b* are over the end openings of the first and second cylinder bores 7 and 8, respectively. The suction valve 9 further includes suction ports 9*e* which are aligned to the respective suction passages 2*e*. Moreover, the suction valve 9 includes first and second discharge ports 9*c* and 9*d* which are provided on or adjacent to the bases of the triangular first and second valve portions 9*a* and 9*b* so that the first and second discharge ports 9*c* and 9*d* open into the first and second cylinder bores 7 and 8, respectively.

With reference to FIG. 2, the first and second cylinder bores 7 and 8 includes recesses 7*a* and 8*a*, respectively, which have a depth from the end face of the cylinder block 2. The recesses 7*a* and 8*a* allow the first and second valve portions 9*a* and 9*b* to bend into the first and second cylinder bores 7 and 8 so that recesses 7*a* and 8*a* receive the apexes of the valve portions 9*a* and 9*b*. The recesses 7*a* and 8*a* also provide stops to limit the bending motion of the valve portions 9*a* and 9*b*. O-rings 10 and 11 are provided along the openings of the first and second cylinder bores 7 and 8.

With reference to FIG. 4, the valve plate 12 is provided between the cylinder block 2 and the rear housing 3 over the suction valve 9. The valve plate 12 includes first and second suction ports 12*a* and 12*c*. The valve plate 12 further includes first and second discharge ports 12*b* and 12*d* which are disposed to open into the first and second cylinder bores 7 and 8, respectively.

The first suction ports 12*a* are disposed in the valve plate 12 to fluidly communicate with the first cylinder bores 7 when the first valve portions 9*a* bend into the recesses 7*a* of the first cylinder bores 7. The second suction ports 12*c* are disposed to fluidly communicate with the second cylinder bores 8 when the second valve portions 9*b* bend into the recesses 8*a* of the second cylinder bores 8. In this context, "open position" of the first and second valve portions 9*a* and 9*b* is referred to the position where the valve portions bend into the corresponding recesses to open the corresponding suction ports in the valve plate 12. On the other hand, "closed position" of the first and second valve portions 9*a* and 9*b* is referred to the position where the valve portions contact the valve plate 12 to close the corresponding suction ports.

First discharge valves 17 and first retainers 18 (FIGS. 1 and 5) are attached to the valve plate 12 over the respective first discharge ports 12*b* by screw bolts 18*a*. The first discharge valves 17 can bend to move between a closed position, where their leading ends contact the valve plate 12 to close the first discharge ports 12*b*, and an open position where their leading ends are away from the valve plate 12 to open the ports 12*b*. Second discharge valves 19 and second retainers 20 are also attached to the valve plate 12 by screw bolts 20*a*. The second discharge valve 19 and retainer 20 are substantially formed into a "Y" shape with three arms so that the arms are positioned over the respective second discharge ports 12*d*. The second discharge valve 19 can bend to move between a closed position, where its arm contact the valve plate 12 to close the second discharge ports 12*d*, and an open position where its arm are away from the second retainer 20 to open the ports 12*d*.

The valve plate 12 further includes suction ports 12*e* which are disposed in the valve plate 12 to be align with the suction passages 2*e* and the suction ports 9*e* of the suction valve 9.

The rear housing 3 defines three suction chambers 15, an intermediate chamber 14 and a discharge chamber 13. The three suction chambers 15 are disposed to fluidly communicate with the respective pairs of suction ports 12*e* and the first suction ports 12*a* so that the suction passages 2*e*, suction ports 9*e* and 12*e* and suction chambers 15 provide a suction channel for the low pressure compression chambers. The intermediate chamber 13 is defined to receive all of the first discharge valves 17 and retainers 18 and to fluidly communicate with the second suction ports 12*c* and the first discharge ports 12*b* when the first discharge valves 17 are in the open positions.

The first discharge port 12*b*, the intermediate chamber 14 and the second suction ports 12*c* provide an intermediate channel between the low pressure compression chambers and the high pressure compression chambers. The discharge chamber 13 is substantially formed into a "Y" shape to receive the second discharge valve 19 and retainer 20, and to fluidly communicate with the second discharge ports 12*d* when the second discharge valve 19 is in the open position.

According to a preferable embodiment of the invention, a reinforcement plate 34 may be attached to the end face of the rear housing 3 to prevent the deformation of the rear housing 3 due to the high pressure in the discharge chamber 13. The reinforcement palate 34 may be attached to the rear housing 2 by a known manner, such as welding or screw bolts. The reinforcement plate 34 includes a central opening 34*a* which allows the connection between the discharge chamber 13 and the automobile air conditioning system 33, as described bellow.

The swash plate chamber 16 is fluidly connected to the air conditioning system 32 through a low pressure conduit 33*a* and an inlet (not shown) provided on the front housing 1, and the discharge chamber 13 is fluidly connected to the air conditioning system 32 through a high pressure conduit 33*b* and a outlet (not shown) provided on the rear housing 3. The central opening allows the high pressure conduit 33*b* and the outlet port to be connected. The refrigerant gas is compressed to a raised pressure or discharge pressure Pd by the compressor and directed to the air conditioning system 32 through a high pressure conduit 33*b*. Within the air conditioning system 32, the compressed refrigerant is expanded, and undergoes heat exchange to reduce the temperature of the air in the compartment. Thereafter the refrigerant is returned to the compressor, in particular, into the swash plate chamber through the low pressure conduit 33*a*. The pressure within the swash plate chamber 16 is referred to as a suction pressure Ps in this specification.

When the air conditioning system is activated, the rotation of the automobile engine is transmitted to the drive shaft 24 through the engine pulley, V-belt, and the compressor pulley. The rotation of the drive shaft 24 is transformed into the reciprocation of the first and second pistons 29 and 30 within the first and second cylinder bores 7 and 8.

When the first piston 7 moves toward the bottom dead center, left in FIG. 1, the corresponding low pressure compression chamber is in the suction phase. A vacuum, which has a pressure lower than the suction pressure Ps, is induced in the low pressure compression chamber during the suction phase. The refrigerant gas in the swash plate chamber 16 is directed to the low pressure compression chamber, which is in the suction phase, through the corresponding passage 2*e*, suction port 12*e*, suction chamber 15, and first suction port 12*a* which provide the suction channel. At that time, the corresponding first valve portion 9*a* is in the open position due the pressure difference between the low pressure compression chamber and the suction chamber 15.

The refrigerant gas within the low pressure compression chamber, which is in the compressing phase in which the first piston 29 moves toward the top dead center, is compressed to an intermediate pressure Pm and discharged to the intermediate chamber 14 through the first discharge port 12*b*.

The refrigerant gas is then directed to the high pressure compression chamber which is in the suction phase, through the corresponding second suction port 12*c*. At that time, the corresponding second valve portion 9*b* is in the open position.

The refrigerant gas within the high pressure compression chamber, which is in the compressing phase, is compressed to the discharge pressure Pd and discharged to the discharge chamber 13 through the second discharge port 12*d*.

The relation between the diameters $D_1$ and $D_2$ of the first and second cylinders and the pressures Ps, Pm, and Pd is defined by the following equation.

$$D_1^2/D_2^2=PsPd/Pm^2$$

According to the embodiment of the invention, the low and high pressure compression chambers, each of which includes three chambers, are alternatively arranged at equal angles around the drive shaft 24. Therefore, the unbalanced force on the swash plate 25 and the drive shaft 24 is removed. In the above description, the compressor is a two stage compressor. However, the invention can be applied to a multistage compressor which has three or more compressing stages.

As described above, the rear housing 3 includes the discharge chamber 13 which is substantially disposed at the center in the rear housing 3, the intermediate chamber 14 which encloses the discharge chamber 13, and the outermost suction chambers 15. The arrangement is advantageous in preventing the refrigerant gas from escaping from the compressor since the higher pressure is enclosed by the lower pressure so that the pressure differences between the respective chambers of the rear housing 3.

It will also be understood by those skilled in the art that the forgoing description is a preferred embodiment of the disclosed device and that various changes and modifications may be made without departing from the spirit and scope of the invention.

We claim:

1. A multistage compressor for compressing a refrigerant for an automobile air conditioning system, comprising:

a body having a front housing, and a rear housing connected to each other with a cylinder block clamped therebetween, the front housing and the cylinder block defining a swash plate chamber, the cylinder block having a longitudinal axis and including a plurality of sets of cylinder bores arranged parallel to, and around the longitudinal axis;

pistons reciprocally received within the cylinder bores to define a plurality of sets of compression chambers together with the walls of cylinder bores;

a drive shaft for driving the reciprocation of the pistons, the drive shaft being supported by the body for rotation, and drivingly connected to a rotational power source;

a swash plate, mounted to the drive shaft to engage the pistons, for transforming the rotation of the drive shaft into the reciprocation of the pistons;

the sets of the compression chambers being fluidly connected to each other to provide a series of stages for compressing the refrigerant gas; and the cylinder bores being arranged at equal angles around the longitudinal axis in each set of the compression chambers.

2. A multistage compressor according to claim 1, in which the set of cylinder bores includes a first set of cylinder bores and second set of cylinder bores, the first set of cylinder bores having a diameter larger than the second set of cylinder bore so that the first set of compression chambers provides a low pressure stage and the second set of compression chambers provides a high pressure stage.

3. A multistage compressor according to claim 2, in which the first set of compression chambers includes first suction and outlet ports with first suction and discharge valves, the second set of compression chambers includes second suction and outlet ports with second suction and discharge valves;

the rear housing defining a suction chamber which is fluidly connected to the first set of cylinder bores through the first suction port, an intermediate chamber which is fluidly connected to the first set of compression chambers through the first discharge port, and to the second set of compression chambers through the second suction ports, and a discharge chamber which is fluidly connected to the second set of compression chambers through the second discharge port;

the cylinder block including a suction passage extending from the swash plate chamber to the suction chamber; and the refrigerant gas being returned from the air conditioning system to the swash plate chamber at a low pressure and being supplied to the air conditioning system at a raised pressure.

4. A multistage compressor according to claim 3, in which the discharge chamber is radially innermostly disposed in the rear housing, the suction chamber is radially outermostly disposed in the rear housing and the intermediate chamber is disposed between the discharge and the suction chambers.

5. A multistage compressor according to claim 4, further comprising a reinforcement plate attached to the rear housing.

6. A multistage compressor according to claim 5, in which the reinforcement plate includes a central opening.

7. A multistage compressor for compressing a refrigerant for an automobile air conditioning system, comprising:

a body having a front housing, and a rear housing connected to each other with a cylinder block clamped therebetween, the front housing and the cylinder block defining a swash plate chamber, the cylinder block having a longitudinal axis and including a plurality of sets of cylinder bores arranged parallel to, and around the longitudinal axis;

pistons reciprocally received within the cylinder bores to define a plurality of sets of compression chambers together with the walls of cylinder bores;

a drive shaft for driving the reciprocation of the pistons, the drive shaft being supported by the body for rotation, and drivingly connected to a rotational power source;

a swash plate, mounted to the drive shaft to engage the pistons, for transforming the rotation of the drive shaft into the reciprocation of the pistons;

the set of cylinder bores includes a first set of cylinder bores and second set of cylinder bores, the first set of cylinder bores having a diameter larger than the second set of cylinder bore so that a first set of compression chambers provides a low pressure stage and a second set of compression chambers provides a high pressure stage, the low and high pressure stages being fluidly connected to each other to provide a two stage compression process; and the first and second sets of cylinder bores being alternatively arranged around the longitudinal axis in each set of the compression chambers.

8. A multistage compressor according to claim 7, in which the first set of compression chambers includes first suction and outlet ports with first suction and discharge valves, the second set of compression chambers includes second suction and outlet ports with second suction and discharge valves;

the rear housing defining a suction chamber which is fluidly connected to the first set of cylinder bores through the first suction port, an intermediate chamber which is fluidly connected to the first set of compression chambers through the first discharge port, and to the second set of compression chambers through the second suction ports, and a discharge chamber which is fluidly connected to the second set of compression chambers through the second discharge port;

the cylinder block including a suction passage extending from the swash plate chamber to the suction chamber; and the refrigerant gas being returned from the air conditioning system to the swash plate chamber at a low pressure and being supplied to the air conditioning system at a raised pressure.

9. A multistage compressor according to claim 8, in which the discharge chamber is radially innermostly disposed in the rear housing, the suction chamber is radially outermostly disposed in the rear housing and the intermediate chamber is disposed between the discharge and the suction chambers.

10. A multistage compressor according to claim 9, further comprising a reinforcement plate attached to the rear housing.

11. A multistage compressor according to claim 10, in which the reinforcement plate includes a central opening.

* * * * *